US012607367B2

(12) United States Patent
Kim et al.

(10) Patent No.: US 12,607,367 B2
(45) Date of Patent: Apr. 21, 2026

(54) AIR CONDITIONER

(71) Applicant: LG ELECTRONICS INC., Seoul (KR)

(72) Inventors: Jusu Kim, Seoul (KR); Sungoh Choi, Seoul (KR); Beomchan Kim, Seoul (KR); Youngheon Kwon, Seoul (KR); Yeoji Jung, Seoul (KR); Dongkeun Yang, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 158 days.

(21) Appl. No.: 18/106,575

(22) Filed: Feb. 7, 2023

(65) Prior Publication Data

US 2023/0250976 A1 Aug. 10, 2023

(30) Foreign Application Priority Data

Feb. 8, 2022 (KR) ..... 10-2022-0016039

(51) Int. Cl.
*F24F 3/153* (2006.01)
*F24F 11/43* (2018.01)
(Continued)

(52) U.S. Cl.
CPC ..... *F24F 3/153* (2013.01); *F24F 11/43* (2018.01); *F24F 13/30* (2013.01); *F24F 11/84* (2018.01); *F24F 11/86* (2018.01)

(58) Field of Classification Search
CPC ..... F24F 2003/1446; F24F 2003/1452; F24F 2003/144; F24F 3/14; F24F 3/00;
(Continued)

(56) References Cited

U.S. PATENT DOCUMENTS 3,203,196 A * 8/1965 Malkoff ..... F24F 3/153 62/200
3,362,184 A * 1/1968 Jensen ..... F25B 13/00 62/503
(Continued)

FOREIGN PATENT DOCUMENTS

EP 3686516 A1 * 7/2020 ..... F24F 11/43
KR 10-0564449 3/2006
(Continued)

OTHER PUBLICATIONS

WO-2017057861-A2 English Translation (Year: 2017).*
(Continued)

*Primary Examiner* — Frantz F Jules
*Assistant Examiner* — Devon Moore
(74) *Attorney, Agent, or Firm* — KED & ASSOCIATES, LLP

(57) ABSTRACT

An air conditioner is provided that may include a case having a supply flow path formed therein and through which outside air flows into an interior space, a first heat exchanger disposed on the supply flow path, in which refrigerant flows, and that exchanges heat between the air and the refrigerant, a second heat exchanger disposed downstream of the second heat exchanger on the supply flow path, in which refrigerant selectively flows, and that exchanges heat between the air and the refrigerant, and a refrigerant distributer configured to send the refrigerant to the first heat exchanger or the second heat exchanger.

20 Claims, 11 Drawing Sheets

(51) Int. Cl.
*F24F 11/84* (2018.01)
*F24F 11/86* (2018.01)
*F24F 13/30* (2006.01)

(58) Field of Classification Search
CPC ..... F24F 3/153; F24F 11/43; F24F 11/0008; F24F 11/84; F24F 13/30; F25B 40/02; F25B 41/00; F25B 41/20; F25B 41/40; F25B 41/42; F25B 2313/007; F25B 2313/02342; F25B 2313/02343; F25B 2313/02322; F25B 5/02; F25B 5/04
See application file for complete search history.

(56) References Cited

U.S. PATENT DOCUMENTS 4,811,568 A * 3/1989 Horan ..... F25B 5/02 62/200
6,826,921 B1 * 12/2004 Uselton ..... F24F 11/81 62/176.5
9,200,812 B2 * 12/2015 Narikawa ..... F24F 11/30
10,955,149 B2 * 3/2021 Shi ..... F25B 6/04
2020/0240681 A1 * 7/2020 Ryu ..... F25B 13/00

FOREIGN PATENT DOCUMENTS

KR 10-0710390 4/2007
KR 10-0885061 2/2009
KR 20-2009-0006535 7/2009
KR 10-1782839 10/2017
KR 10-2020-0135089 12/2020
WO WO 2015/182463 12/2015
WO WO-2017057861 A2 * 4/2017 ..... F24D 5/12
WO WO-2023000862 A1 * 1/2023 ..... F24F 11/84

OTHER PUBLICATIONS

WO-2023000862-A1 English Translation (Year: 2023).*
Korean Office Action issued in Application No. 10-2022-0016039 dated Dec. 18, 2023.
Korean Notice of Allowance dated Aug. 19, 2024.

* cited by examiner

AIR CONDITIONER

CROSS-REFERENCE TO RELATED APPLICATION(S)

The present application claims priority under 35 U.S.C. 119 and 35 U.S.C. 365 to Korean Patent Application No. 10-2022-0016039, filed in Korea on Feb. 8, 2022, which is hereby incorporated by reference in its entirety.

BACKGROUND

1. Field

An air conditioner including an indoor unit connected to an outdoor unit through a plurality of refrigerant pipes is disclosed herein.

2. Background

In the case of a ventilation system, a temperature of air supplied to an interior space is adjusted through heat exchange between indoor air discharged to the outside and outdoor air supplied to the interior space, or an additional heater is installed to heat the air introduced into the interior space. Accordingly, in a cooling mode, air introduced from the outside may be cooled or dehumidified, and the cooled/dehumidified air may be supplied to the interior space.

Korean Patent No. 10-1782839, which is hereby incorporated by reference, discloses a structure for reheating air introduced into an interior space using a separate heater. In this case, when a temperature of flowing air is controlled using a heater consuming separate power, there is a problem in that energy efficiency decreases as much power is consumed.

Further, a conventional air conditioner has a problem in that indoor humidity increases during a defrosting operation of a heat exchanger. Furthermore, in the conventional air conditioner, a freezing operation does not precede defrosting the heat exchanger, or even if the freezing operation precedes the defrosting of the heat exchanger, there is a problem in that a user feels uncomfortable while low-temperature air is supplied to the interior space during the freezing operation.

BRIEF DESCRIPTION OF THE DRAWINGS

Embodiments will be described in detail with reference to the following drawings in which like reference numerals refer to like elements, and wherein.

DETAILED DESCRIPTION

The attached drawings for illustrating exemplary embodiments are to be referred to in order to gain a sufficient understanding of embodiments, the merits thereof, the objectives accomplished by the embodiments, and a method of achieving them. However, embodiments are not limited to the embodiments disclosed below and may be implemented in various different forms, only the embodiments make the disclosure complete, and common knowledge in the art to which embodiments belong. It is provided to completely inform the person the scope, and the embodiments are only defined by the scope of the claims. Like reference numbers designate like elements throughout the specification.

Hereinafter, embodiments will be described with reference to drawings for explaining an air conditioner according to embodiments.

Figure 1:
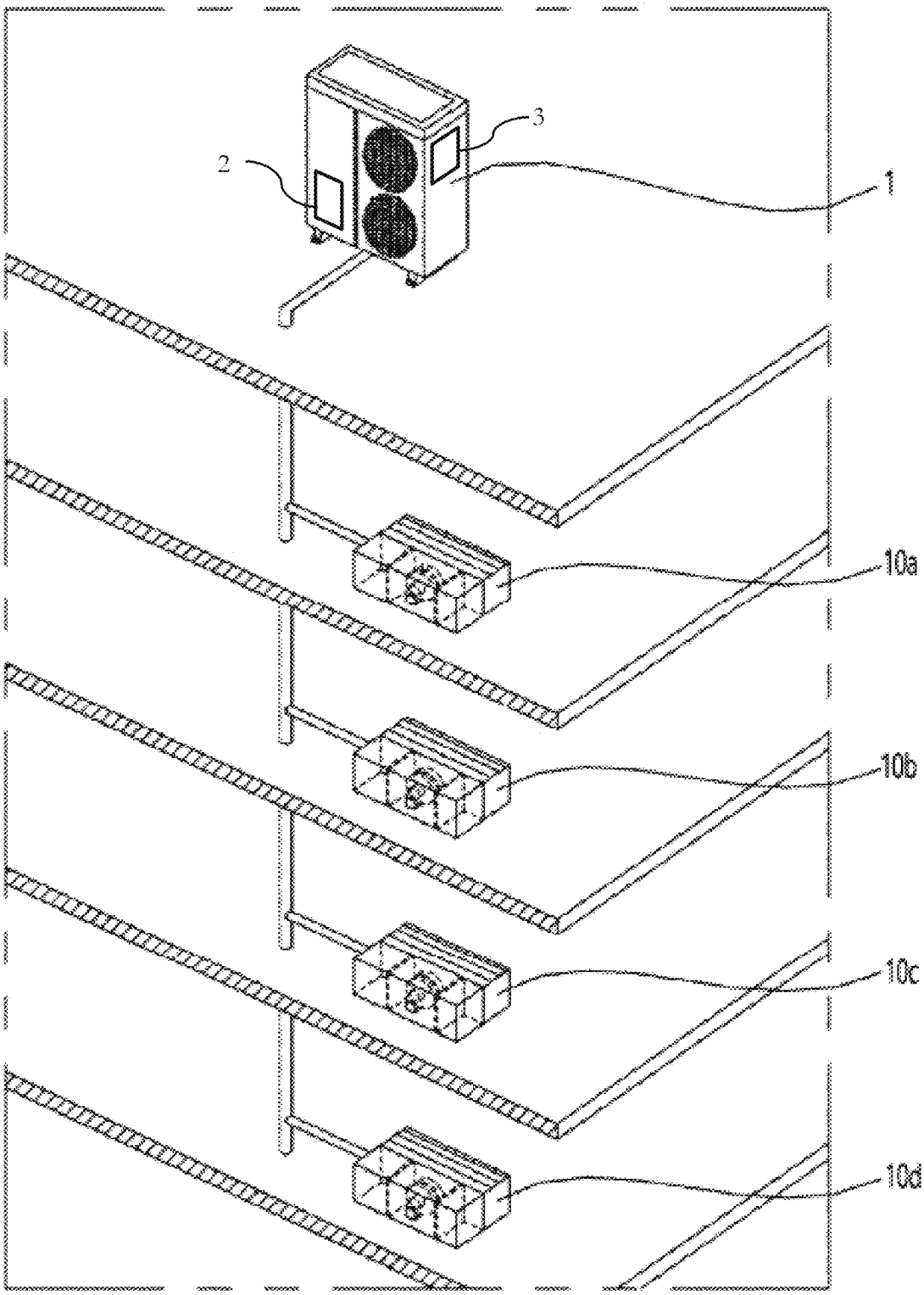
FIG. 1 is a schematic diagram showing an outdoor unit and a plurality of indoor units disposed in a building, for example, according to an embodiment.
Figure 2:
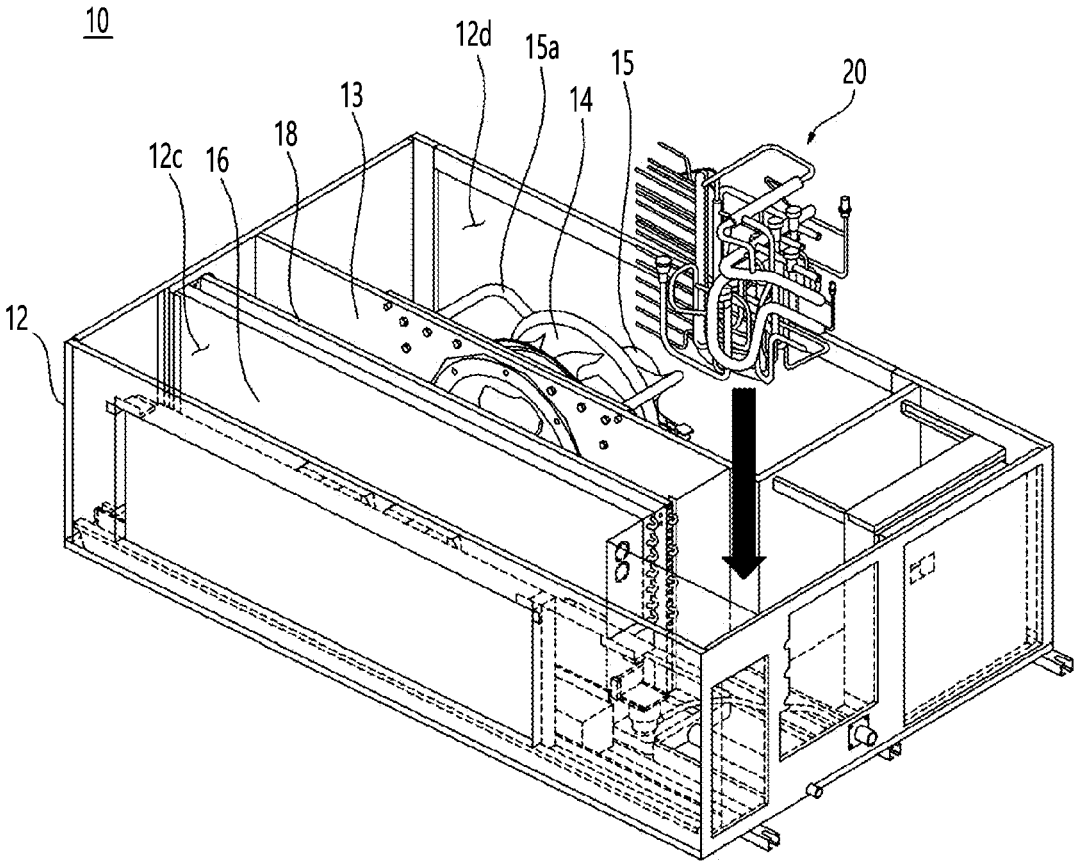
FIG. 2 is a schematic diagram for explaining an internal configuration of the indoor unit according to an embodiment.
Figure 3:
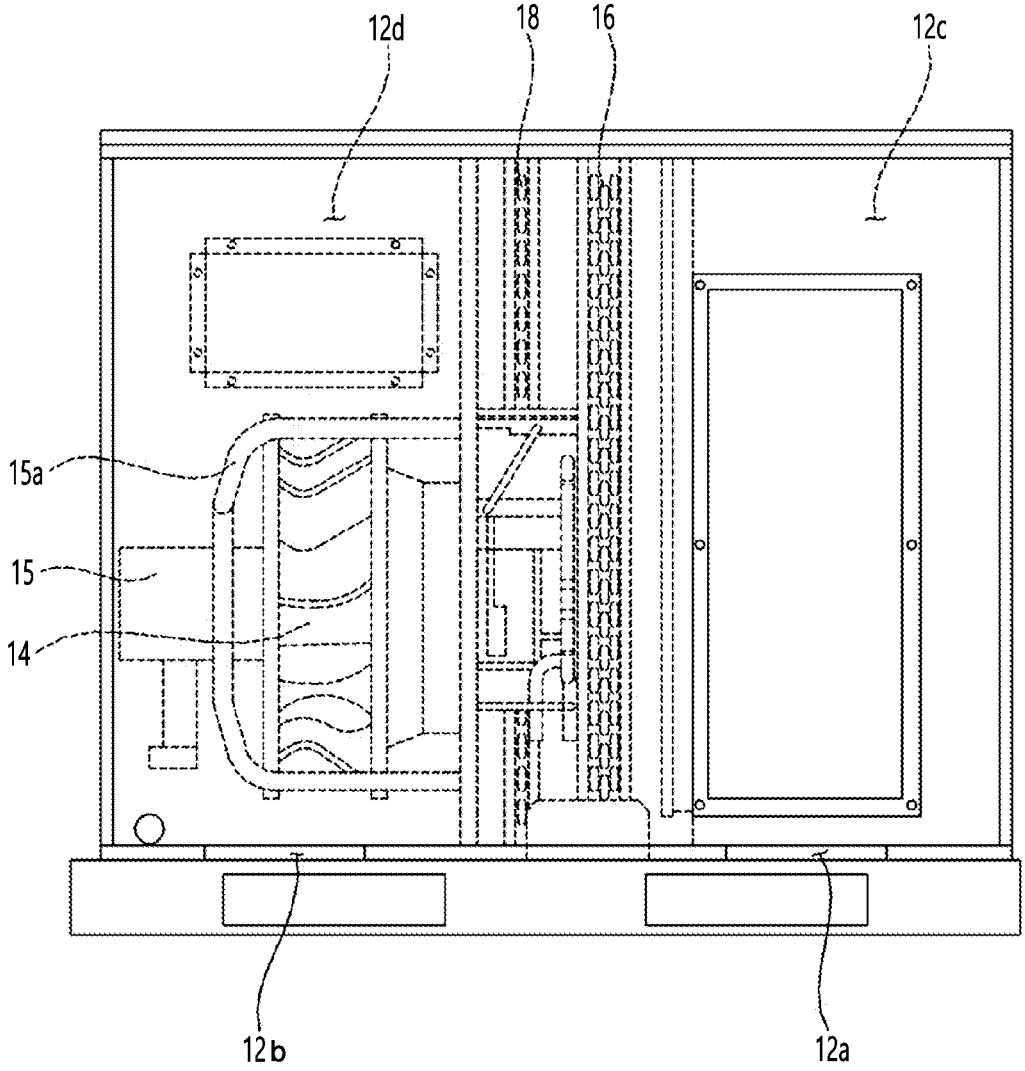
FIG. 3 is a side view for explaining an internal configuration of an indoor unit according to an embodiment.

FIG. 1 is a schematic diagram showing a state in which an outdoor unit and a plurality of indoor units are disposed in a building, for example, according to an embodiment. FIG. 2 is a schematic diagram for explaining an internal configuration of the indoor unit according to an embodiment. FIG. 3 is a side view for explaining an internal configuration of an indoor unit according to an embodiment.

First, referring to FIG. 1, an air conditioner according to an embodiment may include an outdoor unit 1 disposed in an external space of a building, for example, and at least one indoor unit 10(10*a*, 10*b*, 10*c*, and 10*d*) disposed in an indoor space of the building, for example. The air conditioner may include at least one outdoor unit 1 and the plurality of indoor units 10*a*, 10*b*, 10*c*, and 10*d*.

The outdoor unit 1 and the indoor units 10*a*, 10*b*, 10*c*, and 10*d* may be connected through a plurality of refrigerant pipes. The outdoor unit 1 may be connected to the indoor units 10*a*, 10*b*, 10*c*, and 10*d* through three refrigerant pipes 30, 40, and 50 (see FIG. 4). The indoor unit may be a ventilation device that introduces outside air, adjusts a temperature through a heat exchanger, and supplies the indoor air.

Hereinafter, with reference to FIGS. 2 to 8, one indoor unit 10 of the plurality of indoor units 10*a*, 10*b*, 10*c*, and 10*d*, including an internal configuration and flow path of the indoor unit 10, will be described. Thus, the description of the one indoor unit 10 described with reference to FIGS. 2 to 8 may be applied to other multiple indoor units and repetitive description has been omitted.

Referring to FIG. 2, the indoor unit 10 according to an embodiment may include a case 12, which forms an outer shape and a space into which air flows, a blowing fan 14 disposed inside of the case 12 and forming a flow of air, a first heat exchanger 16 disposed in the space formed inside of the case 12 and exchanging heat between the refrigerant and air, a second heat exchanger 18 disposed in the space formed inside of the case 12 and exchanging heat between the refrigerant and air, and a refrigerant distributor 20 connected to the refrigerant pipes 30, 40, and 50 and configured to send refrigerant flowing from the outdoor unit to the first heat exchanger 16 or the second heat exchanger 18.

An inlet 12*a* and an outlet 12*b* may be formed in one side of the case 12. Supply flow paths 12*c* and 12*d* through which air introduced from an interior space flows may be formed inside of the case 12. The supply flow path 12*c*, 12*d* may include discharge chamber 12*d* through which air inside of the case 12 is discharged to the outside and intake chamber 12*c* through which outside air is introduced into the case 12.

A partition wall 13 that partitions the intake chamber 12*c* and the discharge chamber 12*d* may be formed inside of the case 12. A communication hole may be formed in the partition wall 13 to allow air of the intake chamber 12*c* to flow into the discharge chamber 12*d*.

The first heat exchanger 16 and the second heat exchanger 18 may be disposed on the supply flow path. The second heat exchanger 18 may be disposed downstream of the first heat exchanger 16 on the supply flow path. That is, based on a flow direction of air, the first heat exchanger 16 may be disposed first, and the second heat exchanger 18 may be disposed later.

The first heat exchanger 16 and the second heat exchanger 18 may be disposed in the intake chamber 12*c*. The first heat exchanger 16 and the second heat exchanger 18 may be disposed between the partition wall 13 and the inlet 12*a*. The first heat exchanger 16 may be disposed adjacent to the inlet 12*a*, and the second heat exchanger 18 may be disposed adjacent to the partition wall 13. Accordingly, air introduced into the intake chamber 12*c* through the inlet 12*a* may flow into the discharge chamber 12*d* via the first heat exchanger 16 and the second heat exchanger 18.

Figure 4:
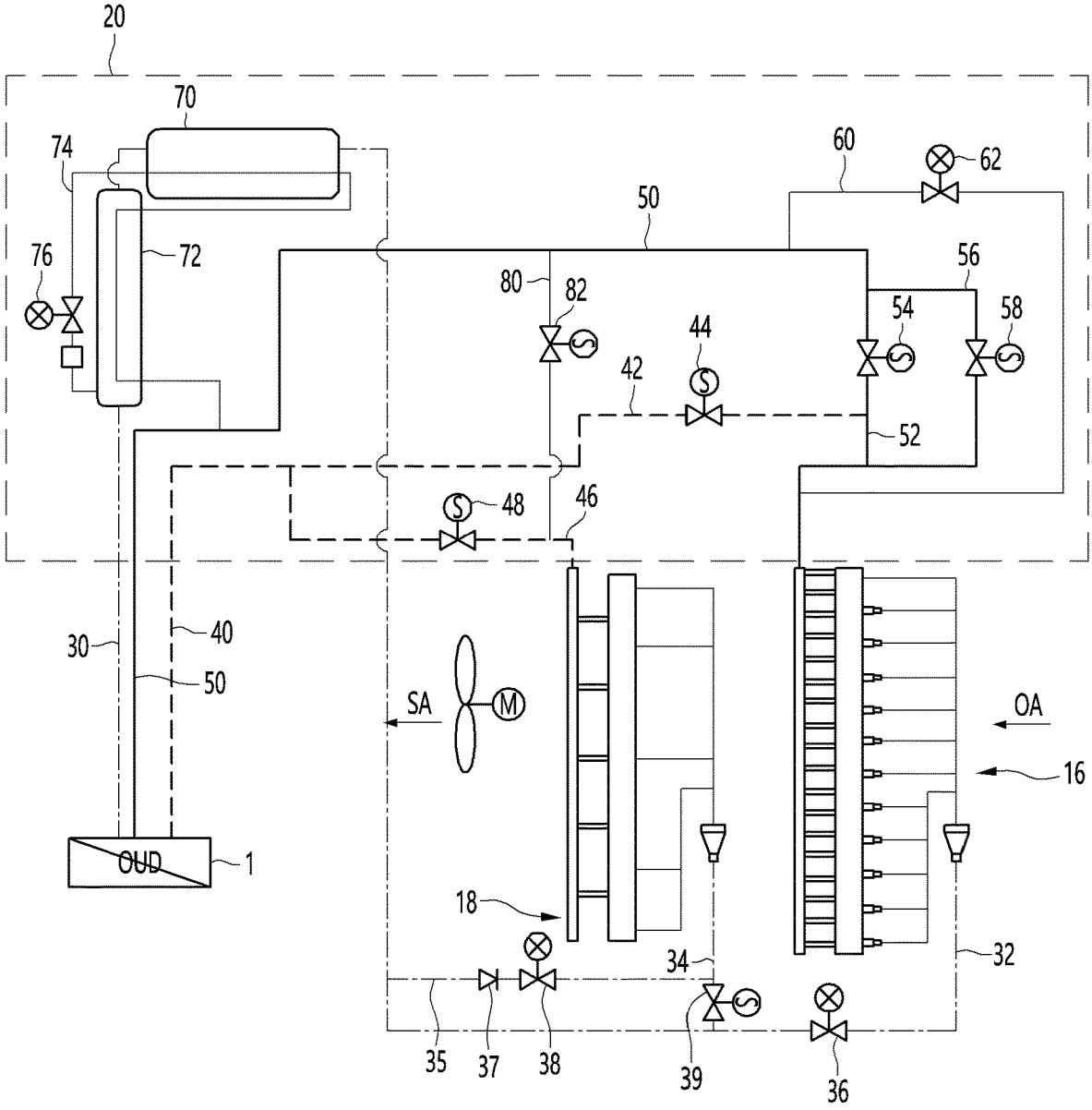
FIG. 4 is a schematic diagram for explaining refrigerant flow of an indoor unit connected to an outdoor unit according to an embodiment.

FIG. 4 is a schematic diagram for explaining refrigerant flow of an indoor unit connected to an outdoor unit according to an embodiment. Referring to FIG. 4, a flow rate of the refrigerant flowing through the first heat exchanger 16 may be greater than a flow rate of the refrigerant flowing through the second heat exchanger 18. That is, a passage area of the first heat exchanger 16 may be larger than that of the second heat exchanger 18.

Therefore, the temperature of air in the first heat exchanger 16 may be changed more than in the second heat exchanger 18. That is, referring to FIG. 7, as a cooling performance of the first heat exchanger 16 is greater than a heating performance of the second heat exchanger 18, air may be cooled through the first heat exchanger 16 and dehumidified through the second heat exchanger 18, and the cooled and dehumidified air may enter the interior space.

The blowing fan 14 and a fan motor 15 that rotates the blowing fan 14 may be disposed in the discharge chamber 12*d*. A fan supporter 15*a* that supports the blowing fan 14 and the fan motor 15 may be disposed in the discharge chamber 12*d*. The blowing fan 14 may be, for example, a plug fan having a suction port formed in a direction in which a rotational axis is formed and a discharge port formed in a direction perpendicular to the rotational axis.

A space in which the refrigerant distributor 20 connected to the first heat exchanger 16 and the second heat exchanger 18 is disposed may be formed inside of the case 12. An area in which the refrigerant distributor 20 is disposed may be disposed on one side of the intake chamber 12*c*.

The refrigerant distributor 20 may be disposed inside of the case 12 and may connect the outdoor unit 1 to the first heat exchanger 16 and the second heat exchanger 18. Further, the refrigerant distributor 20 may include the plurality of refrigerant pipes 30, 40, and 50 and a plurality of valves.

The refrigerant distributor 20 may include liquid pipe 30 that connects the outdoor unit 1 to the first heat exchanger 16 and the second heat exchanger 18 and through which liquid refrigerant flows, a first pipe 40 that connects the outdoor unit 1 to the first heat exchanger 16 and the second heat exchanger 18 and through which vapor phase refrigerant flows, and a second pipe 50 that connects the outdoor unit 1 and the first heat exchanger 16. The refrigerant distributor 20 may include first pipe valves 44 and 48 that are disposed in the first pipe 40 and sends refrigerant flowing through the first pipe 40 to the first heat exchanger 16 or the second heat exchanger 18, and second pipe valves 54 and 58 disposed in the second pipe 50 and open and close the second pipe 50.

In the liquid pipe 30, supercoolers 70 and 72 that supercool the refrigerant flowing in the liquid pipe 30 by expanding and exchanging heat with a portion of the refrigerant flowing in the liquid pipe 30 may be disposed. Referring to FIG. 4, the subcoolers 70 and 72 may include first subcooler 70, and second subcooler 72 disposed upstream of the first subcooler 70 in the liquid pipe 30.

The refrigerant branched and expanded in the liquid pipe 30 may flow through a branch pipe 74. A flow path may be formed to allow the refrigerant flowing along the branch pipe 74 to sequentially pass through the first supercooler 70 and the second supercooler 72 after passing through a supercooled expansion valve 76. The branch pipe 74 may form a flow path to allow the refrigerant passing through the second supercooler 72 to flow into the second pipe 50.

Referring to FIG. 4, based on the first pipe 40 through which the vapor phase refrigerant flows from the outdoor unit 1 to the indoor unit 10, the first heat exchanger 16 may be disposed downstream of the second heat exchanger 18. The refrigerant branched and flowing in the first pipe 40 may be arranged to flow to the first heat exchanger 16 via the second heat exchanger 18.

The first pipe 40 may be branched into a (1-1)$^{th}$ pipe 42 connected to the first heat exchanger 16 and a (1-2)$^{th}$ pipe 46 connected to the second heat exchanger 18. A (1-1)$^{th}$ pipe valve 44 that opens and closes the (1-1)$^{th}$ pipe 42 may be disposed on the (1-1)$^{th}$ pipe 42. A (1-2)$^{th}$ pipe valve 48 that opens and closes the (1-2)$^{th}$ pipe 46 may be disposed on the (1-2)$^{th}$ pipe 46.

The second pipe 50 may include a first parallel pipe 52 and a second parallel pipe 56. The first parallel pipe 52 and the second parallel pipe 56 may be branched and combined in parallel inside of the refrigerant distributor 20. Refrigerant discharged from the first heat exchanger 16 may be low-pressure refrigerant, and may cause pressure loss. Therefore, a flow of the refrigerant may be branched and combined with the two parallel pipes 52 and 56, and thus, may reduce pressure loss in the low-pressure refrigerant.

A first parallel pipe valve 54 that opens and closes the first parallel pipe 52 may be disposed on the first parallel pipe 52.

A second parallel pipe valve 58 that opens and closes the second parallel pipe 56 may be disposed on the second parallel pipe 56.

The second pipe 50 may further include a pressure regulating pipe 60 branched upstream of the first parallel pipe 52 and the second parallel pipe 56 and combined downstream of the first parallel pipe 52 and the second parallel pipe 56. A pressure regulating pipe valve 62 that opens and closes the pressure regulating pipe 60 may be disposed on the pressure regulating pipe 60.

The refrigerant flowing through the first parallel pipe 52 and the second parallel pipe 56 may generate a pressure in the first parallel pipe valve 54 and the second parallel pipe valve 58 when a compressor 2 is stopped. When a flow of the refrigerant is stopped due to stop of the compressor, if the first parallel pipe 52 and the second parallel pipe 56 are closed through the first parallel pipe valve 54 and the second parallel pipe valve 58, and the pressure regulating pipe 60 is opened through the pressure regulating pipe valve 62, pressures at both ends of the second pipe 50 may be matched.

The refrigerant distributor 20 may include a connection pipe (or third pipe) 80 that connects the first pipe 40 and the second pipe 50, and a connection pipe valve (or third pipe valve) 82 that opens and closes the connection pipe 80. When liquid refrigerant is generated due to condensation of refrigerant in the first pipe 40 in which high-pressure refrigerant flows, the connection pipe 80 may be opened through the connection pipe valve 82 to send the condensed refrigerant to the second pipe 50 in which low-pressure refrigerant flows.

Referring to FIG. 4, the connection pipe 80 may connect the $(\mathbf{1\text{-}2})^{th}$ pipe 46 and the second pipe 50. Referring to FIG. 4, the first parallel pipe 52 may be connected to the $(\mathbf{1\text{-}1})^{th}$ pipe 42.

Referring to FIG. 4, the liquid pipe 30 of the refrigerant distributor 20 may be branched into first liquid pipe 32 and second liquid pipe 34 connected to the first heat exchanger 16 and the second heat exchanger 18, respectively. The first liquid pipe 32 may be connected to the first heat exchanger 16. A first expansion valve 36 that expands refrigerant flowing into the first heat exchanger 16 may be disposed on the first liquid pipe 32.

Figure 5:
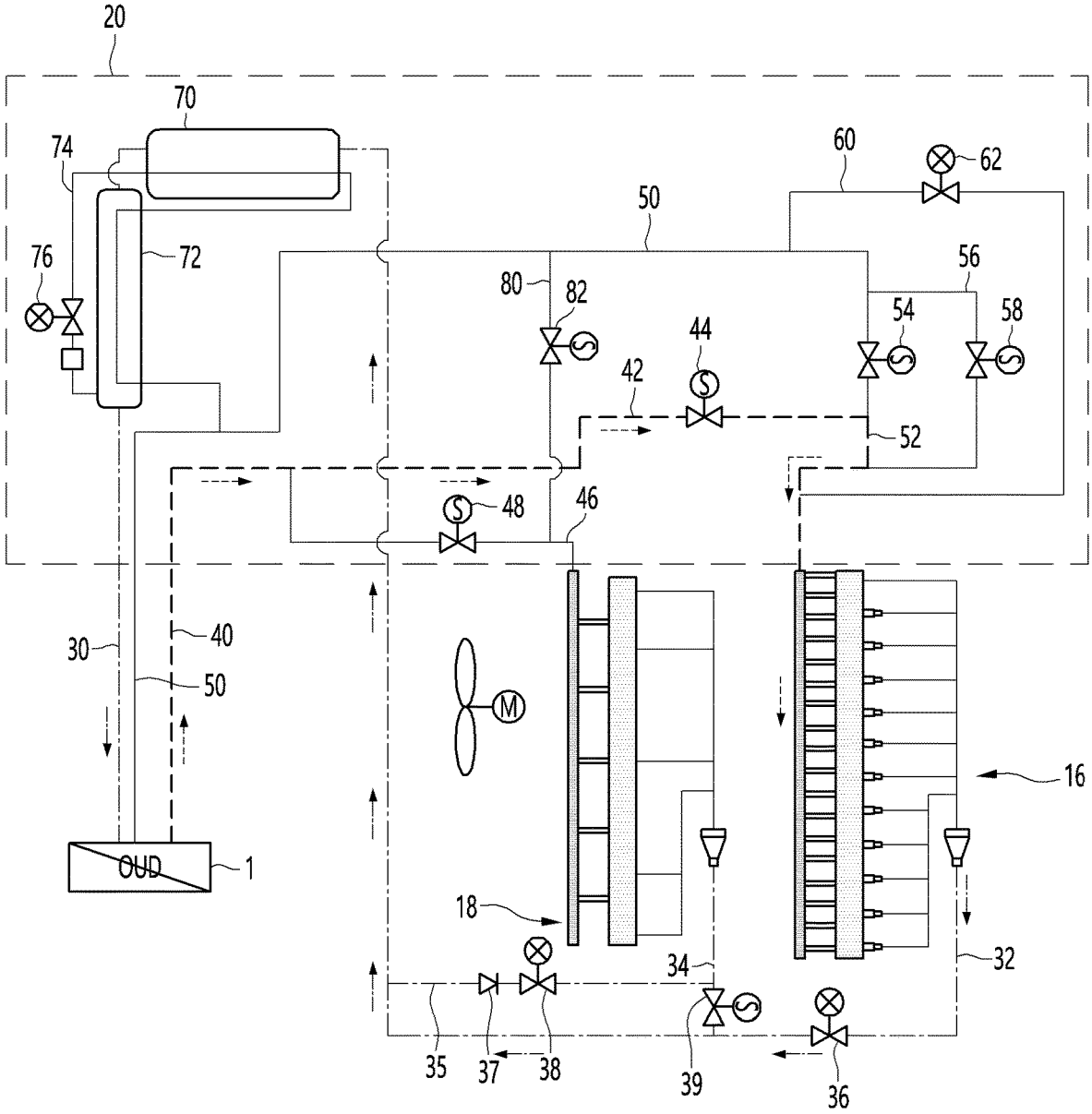
FIG. 5 is a schematic diagram for explaining a direction of a flow of refrigerant in an all heating mode and an individual heating mode in an indoor unit according to an embodiment.
Figure 6:
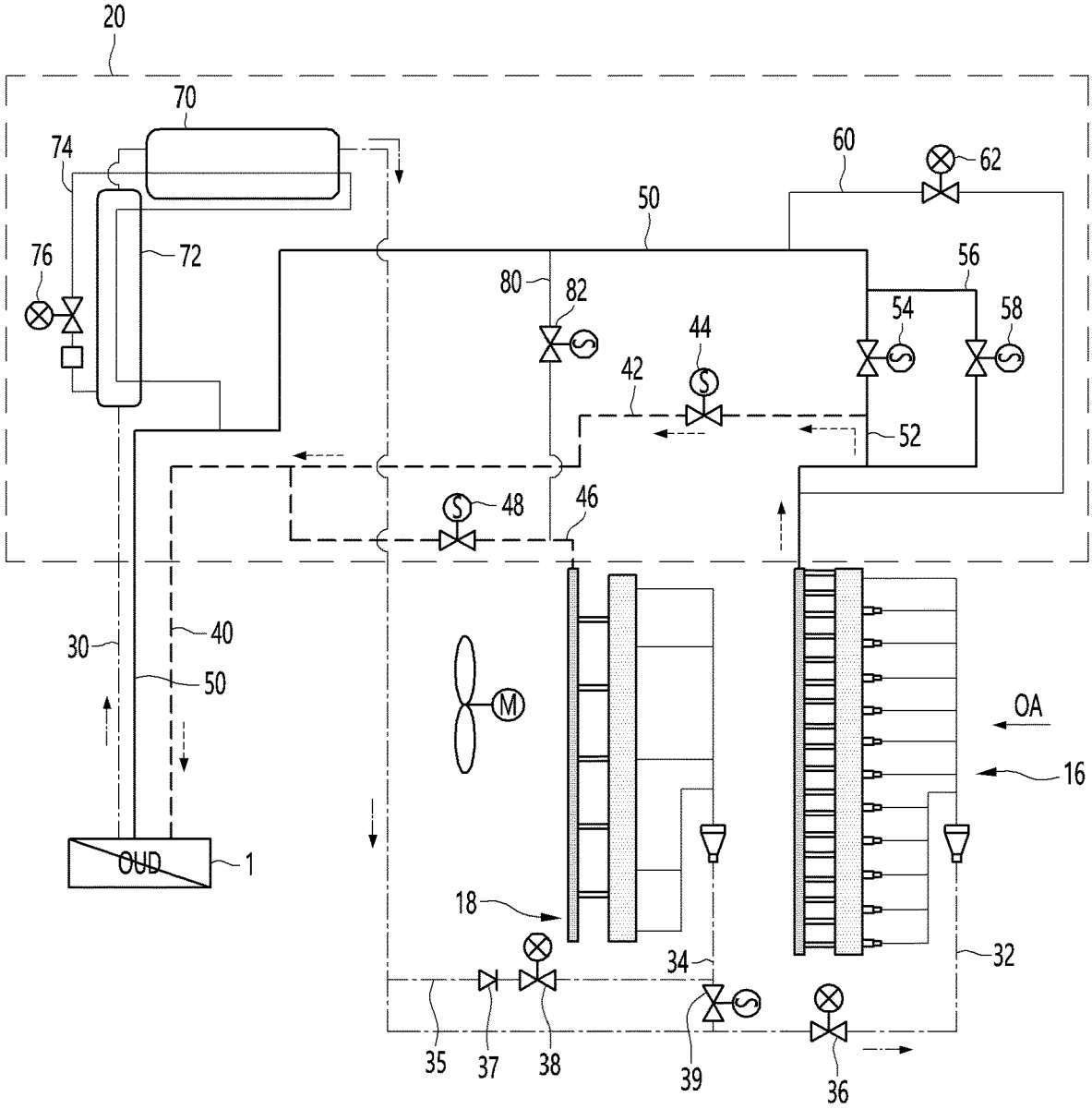
FIG. 6 is a schematic diagram for explaining a direction of a flow of refrigerant in a full cooling mode in an indoor unit according to an embodiment.
Figure 7:
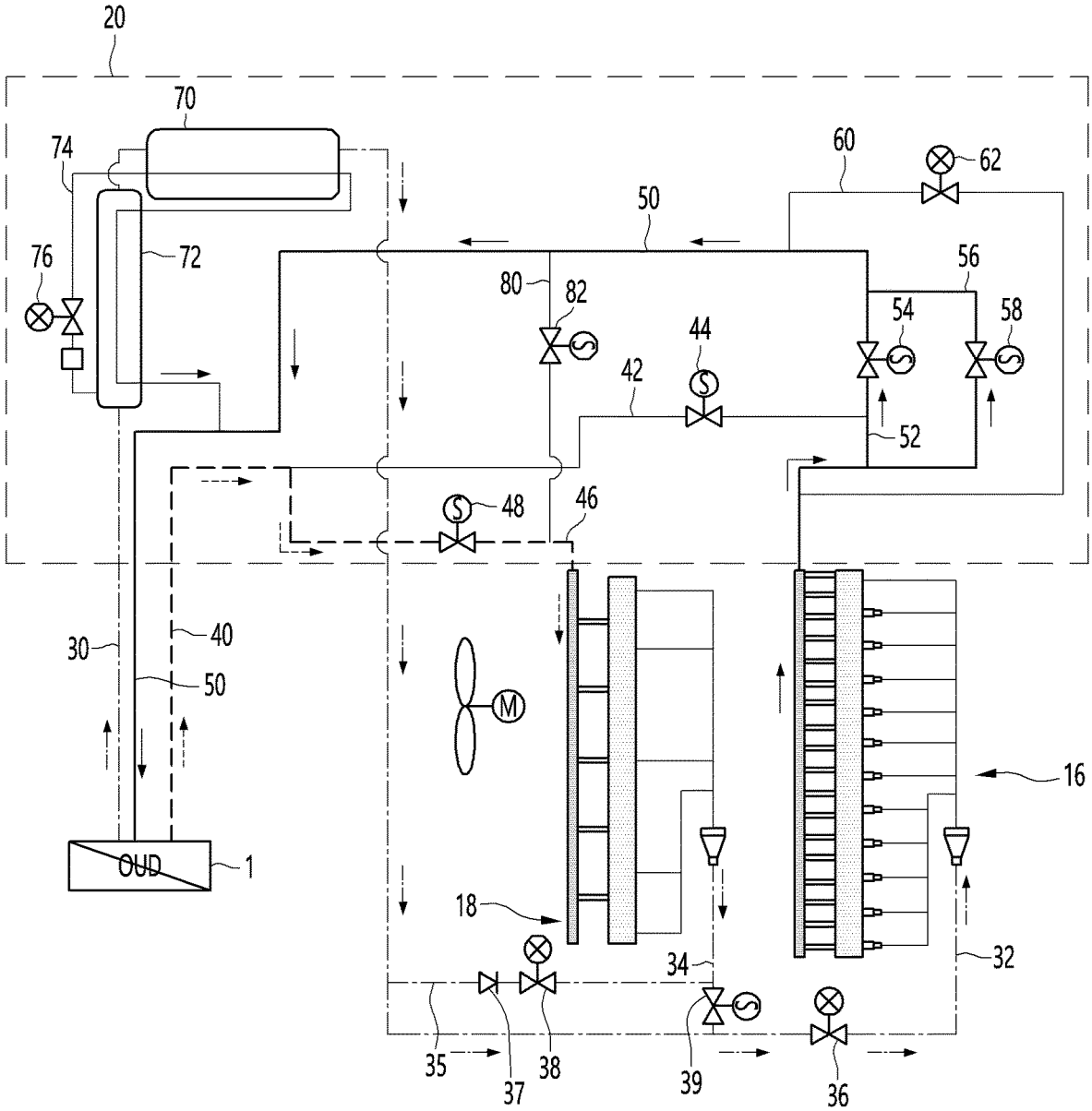
FIG. 7 is a schematic diagram for explaining a direction of a flow of refrigerant in a partial cooling mode and a freezing mode in an indoor unit according to an embodiment.
Figure 8:
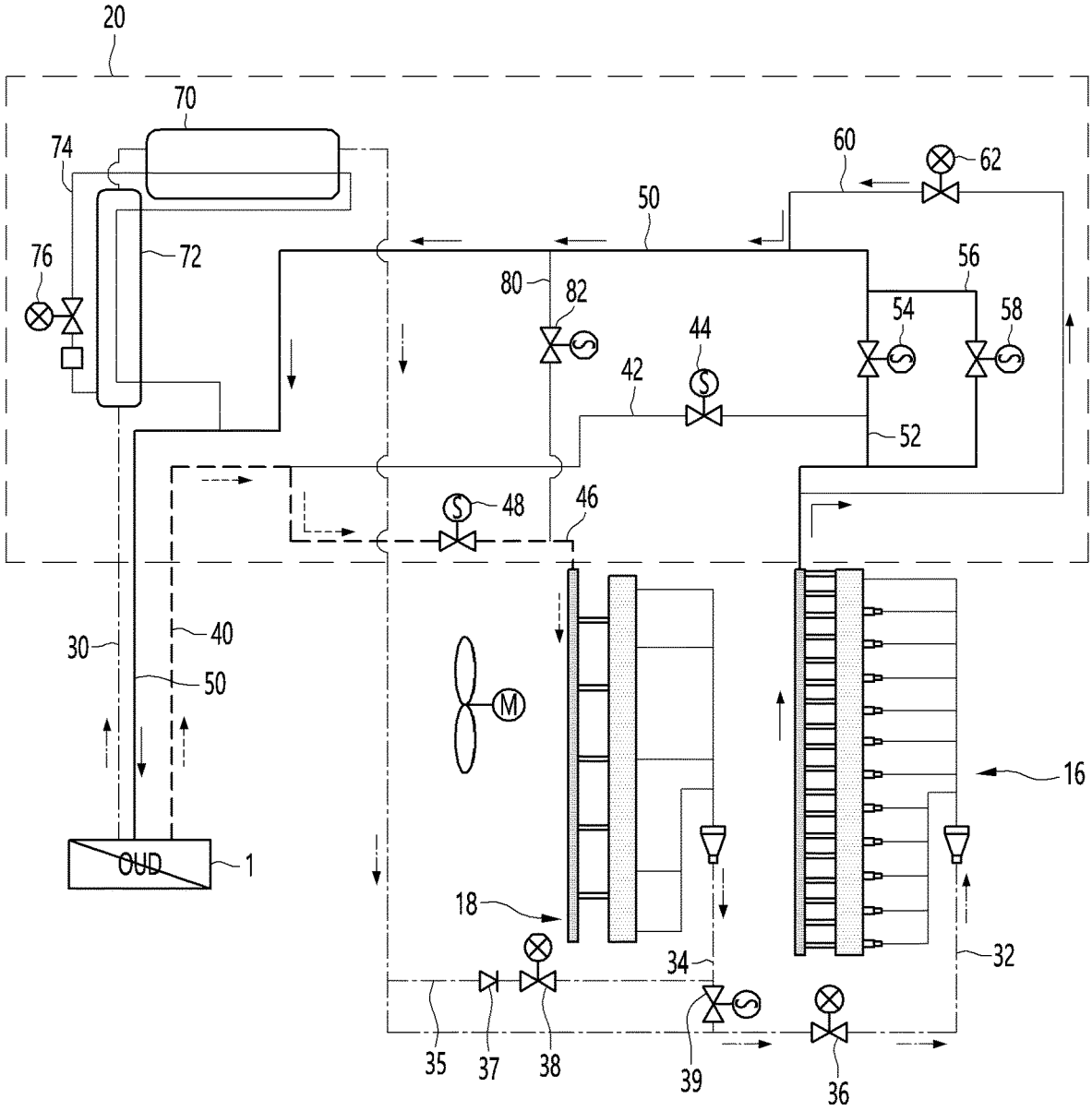
FIG. 8 is a schematic diagram for explaining a direction of a flow of refrigerant in a state in which a partial cooling mode is terminated in an indoor unit according to an embodiment.

FIG. 5 is a schematic diagram for explaining a direction of a flow of refrigerant in an all heating mode and an individual heating mode in an indoor unit according to an embodiment. FIG. 6 is a schematic diagram for explaining a direction of a flow of refrigerant in a full cooling mode in an indoor unit according to an embodiment. FIG. 7 is a schematic diagram for explaining a direction of a flow of refrigerant in a partial cooling mode and a freezing mode in an indoor unit according to an embodiment. FIG. 8 is a schematic diagram for explaining a direction of a flow of refrigerant in a state in which a partial cooling mode is terminated in an indoor unit according to an embodiment.

Hereinafter, a flow of refrigerant according to a mode of an air conditioner according to embodiments will be described with reference to FIGS. 5 to 8

In the air conditioner according to embodiments, one outdoor unit 1 may be connected to the plurality of the indoor units 10. The air conditioner according to embodiments may be used in an all heating mode M1 in which all of the plurality of indoor units 10 are used for heating, an all cooling mode M2 in which all of the plurality of indoor units 10 are used for cooling, an individual heating mode M3 in which only some of the plurality of the indoor units 10 are used for heating, and an individual cooling mode M4 in which only some of the plurality of the indoor units 10 are used for cooling.

With reference to FIG. 5, the all heating mode M1 and the individual heating mode M3 will be described. In the all heating mode M1 and the individual heating mode M3, only the liquid pipe 30 and the first pipe 40 may be used, and refrigerant may not flow into the second pipe 50. In the all heating mode M1 and the individual heating mode M3, the refrigerant may flow through the same flow path. In the all heating mode M1 and the individual heating mode M3, the refrigerant from the outdoor unit 1 may flow into the indoor unit 10 through the first pipe 40, and the refrigerant from the indoor unit 10 may flow into the outdoor unit 1 through the liquid pipe 30. In the all heating mode M1 and the individual heating mode M3, refrigerant may flow into the first heat exchanger 16, and refrigerant may not flow into the second heat exchanger 18.

In the all heating mode M1 and the individual heating mode M3, the refrigerant discharged from the compressor may flow into the first heat exchanger 16 through the first pipe 40. Accordingly, the $(\mathbf{1\text{-}1})^{th}$ pipe valve 44 may open the $(\mathbf{1\text{-}1})^{th}$ pipe 42, and the $(\mathbf{1\text{-}2})^{th}$ pipe valve 48 may close the $(\mathbf{1\text{-}2})^{th}$ pipe 46. Therefore, the refrigerant flowing through the first pipe 40 may flow into the first heat exchanger 16. The first heat exchanger 16 may be used as a condenser that exchanges heat from high-pressure vapor phase refrigerant to a liquid phase.

The refrigerant discharged from the first heat exchanger 16 may flow into the outdoor unit 1 along the liquid pipe 30. The supercoolers 70 and 72 disposed on the liquid pipe 30 may not operate separately.

With reference to FIG. 6, the all cooling mode M2 will be described. In the all cooling mode M2, only the liquid pipe 30 and the first pipe 40 may be used, and refrigerant may not flow into the second pipe 50. In the all cooling mode M2, the refrigerant from the outdoor unit 1 may be introduced into the indoor unit 10 through the liquid pipe 30, and the refrigerant of the indoor unit 10 may flow into the outdoor unit 1 through the first pipe 40. In the all cooling mode M2, refrigerant may flow into the first heat exchanger 16, and refrigerant may not flow into the second heat exchanger 18.

In the all cooling mode M2, the refrigerant discharged from the compressor may pass through an outdoor heat exchanger 3 and may flow into the first heat exchanger 16 through the liquid pipe 30. The refrigerant flowing through the liquid pipe 30 may flow into the first liquid pipe 32, may pass through the first expansion valve 36, and may flow into the first heat exchanger 16. In this case, the $(\mathbf{1\text{-}2})^{th}$ pipe valve 48 may close the $(\mathbf{1\text{-}2})^{th}$ pipe 46, and thus, refrigerant may not flow into the second liquid pipe 34. The first heat exchanger 16 may be used as an evaporator to change a phase of liquid refrigerant to low-pressure vapor phase refrigerant. The refrigerant discharged from the first heat exchanger 16 may flow into the first pipe 40 through the $(\mathbf{1\text{-}1})^{th}$ pipe 42 and may flow into the outdoor unit 1.

With reference to FIGS. 7 to 8, the individual cooling mode M4 will be described. In the individual cooling mode M4, refrigerant may flow into the liquid pipe 30, the first pipe 40, and the second pipe 50. Refrigerant may flow into the indoor unit 10 from the outdoor unit 1 through the liquid pipe 30 and the first pipe 40, and the refrigerant of the indoor unit 10 may flow into the outdoor unit 1 through the second pipe 50.

The $(\mathbf{1\text{-}1})^{th}$ pipe valve 44 may close the $(\mathbf{1\text{-}1})^{th}$ pipe 42, and the $(\mathbf{1\text{-}2})^{th}$ pipe valve 48 may open the $(\mathbf{1\text{-}2})^{th}$ pipe 46. Thus, high-pressure refrigerant flowing along the first pipe 40 may flow into the second heat exchanger 18. The second heat exchanger 18 may be used as a condenser to heat the flowing air.

The refrigerant discharged from the second heat exchanger 18 may flow along the second liquid pipe 34 and the first liquid pipe 32 to the first heat exchanger 16. The refrigerant flowing along the liquid pipe 30 may flow along the first liquid pipe 32 and may flow into the first heat exchanger 16. A portion of the refrigerant flowing along the liquid pipe 30 may flow along the branch pipe 74, may pass through the supercooled expansion valve 76, may sequentially pass through the first supercooler 70 and the second supercooler 72, and may supercool the refrigerant flowing through the liquid pipe 30. The refrigerant flowing through the branch pipe 74 may flow into the outdoor unit 1 through the second pipe 50.

The first heat exchanger 16 may be used as an evaporator. Accordingly, air that is cooled and having a lowered humidity while passing through the first heat exchanger 16 may be partially heated while passing through the second heat exchanger 18 and introduced into the interior space in a state in which relative humidity is lowered. Accordingly, the air passing through the first heat exchanger 16 and the second heat exchanger 18 may be introduced into the interior space in a cooled and dehumidified state.

The refrigerant flowing from the first heat exchanger 16 may flow along the second pipe 50. Referring to FIG. 7, when the compressor is driven, the first parallel pipe valve 54 and the second parallel pipe valve 58 may open the first parallel pipe 52 and the second parallel pipe 56, and the pressure regulating pipe valve 62 may close the pressure regulating pipe 60. Accordingly, the refrigerant flowing from the first heat exchanger 16 may flow along the first parallel pipe 52 and the second parallel pipe 56.

The refrigerant discharged from the first heat exchanger 16 is low-pressure refrigerant, and when the refrigerant flows through one pipe, a pressure loss of the vapor phase refrigerant may be large. In embodiments, the pressure loss of the refrigerant flowing from the first heat exchanger 16 may be reduced by branching and combining the second pipe 50 into the first parallel pipe 52 and the second parallel pipe 56. The refrigerant flowing in the second pipe 50 may flow into a compressor of the outdoor unit 1.

However, when an operation of the compressor is stopped, the first parallel pipe valve 54 and the second parallel pipe valve 58 may close the first parallel pipe 52 and the second parallel pipe 56, and the pressure regulating pipe valve 62 may open the pressure regulating pipe 60, as shown in FIG. 8.

When the operation of the compressor is stopped, if the first parallel pipe valve 54 and the second parallel pipe valve 58 close the first parallel pipe 52 and the second parallel pipe 56, pressure may be generated in the first parallel pipe valve 54 and the second parallel pipe valve 58. In this case, when the pressure regulating pipe 60 is opened through the pressure regulating pipe valve 62, pressures at both ends of the second pipe 50 may be matched.

The air conditioner according to embodiments as described above may be a system that uses a method of introducing outside air, and dehumidifying, reheating, cooling, and heating the outside air, cools and dehumidifies the outside air, reheats the air to a temperature set by an indoor user, and supplies the air indoors (see FIG. 7).

In this case, as the air conditioner of the embodiments introduces outside air, external contaminants, such as dust, may be adsorbed into the heat exchanger, more particularly, the evaporation heat exchanger. In addition, as the evaporation heat exchanger is mainly operated for cooling and dehumidification, a large amount of condensed water may form on a surface of the heat exchanger, and microorganisms, such as bacteria and fungi, may propagate, which cause unsanitary and odor problems.

In the case of a conventional freeze cleaning method, foreign substances are removed together while performing a defrosting operation in which frost is formed on the heat exchanger to remove surface frost. However, during the defrosting operation, condensed water is discharged and moisture is introduced into the interior space, which may increase a load (latent heat) of the heating and cooling system. In addition, when the indoor heat exchanger is frozen, there is a problem in that user discomfort increases because cold wind below 0° C. is introduced into the interior space.

Figure 9:
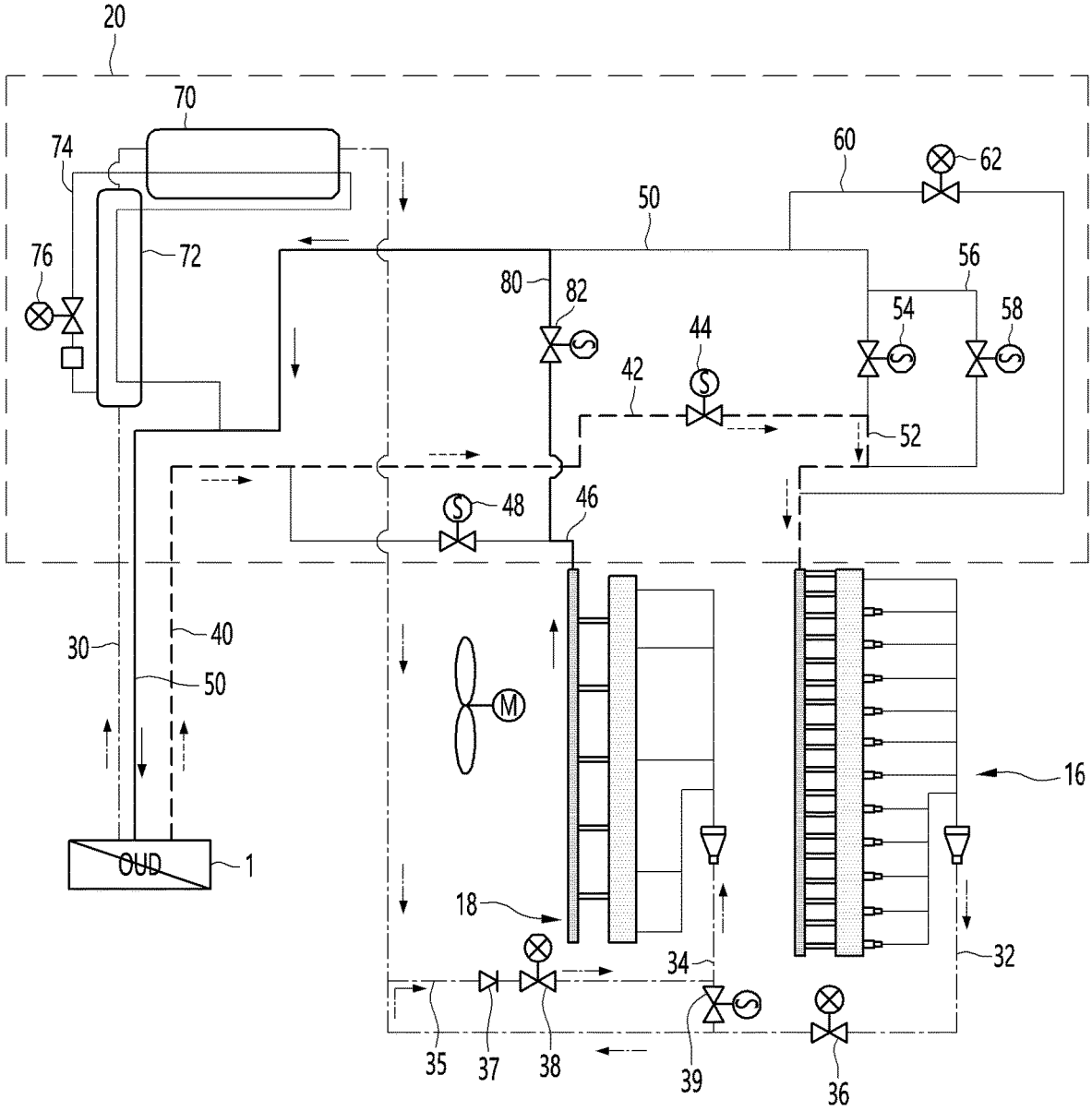
FIG. 9 is a schematic diagram for explaining a direction of a flow of refrigerant in a defrost mode in an indoor unit according to an embodiment.
Figure 10:
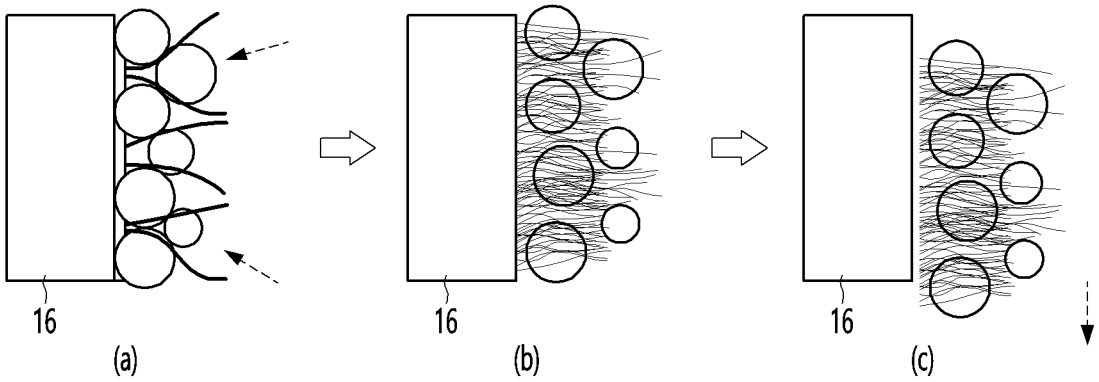
FIG. 10(*a*) to (*c*) is a schematic diagram showing a process of defrosting an indoor unit according to an embodiment.

FIG. 9 is a schematic diagram for explaining a direction of a flow of refrigerant in a defrost mode in an indoor unit according to an embodiment. FIG. 10 is a schematic diagram showing a process of defrosting an indoor unit according to an embodiment.

Referring to FIGS. 9 to 10, according to embodiments, freeze defrosting of the heat exchanger may be possible. That is, a third liquid pipe 35 branched from the liquid pipe 30 and then combined with the second liquid pipe 34 may be formed.

One (first) side of the third liquid pipe 35 may be branched from the liquid pipe 30 before branching to a side of the second heat exchanger 18. The other (second) side of the third liquid pipe 35 may be combined with the second liquid pipe 34 branched to a side of the second heat exchanger 18.

A check valve 37 and a second expansion valve 38 that restrict a flow of refrigerant in one direction (from left to right in FIG. 9) may be disposed on the third liquid pipe 35. Based on a flow path of the refrigerant, the check valve 37 may be disposed first, and the second expansion valve 38 may be disposed downstream thereof. Therefore, the refrigerant introduced into the third liquid pipe 35 may flow through the check valve 37 and then only flow toward the second expansion valve 38. Then, the refrigerant sequentially passing through the check valve 37 and the second expansion valve 38 may flow into the second heat exchanger 18 through the second liquid pipe 34. For reference, when the check valve 37 is provided as described above, reverse flow of liquid refrigerant may be prevented in the heating mode.

A flow limiting valve 39 that regulates the flow of the refrigerant may be disposed in the second liquid pipe 34 branched to a side of the second heat exchanger 18. The flow limiting valve 39 may be disposed in the second liquid pipe 34 before the third liquid pipe 35 is combined.

As described above, when the third liquid pipe 35 and the second expansion valve 38 are provided, the second heat exchanger 18 may be used as a condensation heat exchanger as well as an evaporation heat exchanger. The first heat exchanger 16 and the second heat exchanger 18 may be used alternately. In particular, the first heat exchanger 16 may be used as an evaporation heat exchanger and the second heat exchanger 18 may be used as a condensation heat exchanger, and then the first heat exchanger 16 may be used as a condensation heat exchanger and the second heat exchanger 18 may be used as an evaporation heat exchanger. Through this, dehumidification may be performed by condensing moisture in air introduced into the interior space during a drying operation for freeze cleaning, and there is an effect of shortening a total freeze cleaning time by rapidly drying the heat exchanger.

As described above, when the evaporation heat exchanger and the condensation heat exchanger are installed together in the indoor unit, the heat exchangers 16 and 18 may be alternately driven through valve control. In a freeze-cleaning operation cycle for cleaning the heat exchanger, a flow path of refrigerant may be varied according to an outdoor condition and an operation mode, and a flow rate of the condensation heat exchanger may be controlled to prevent low-temperature air from flowing into the interior space during the condensation and freezing operation. In addition, continuous dehumidification may be possible by changing the flow path of the refrigerant in a defrosting and drying logic after freezing is completed.

Table 1 below summarizes whether or not a valve is open for each mode.

TABLE 1

| | individual cooling mode (cooling dehumidification) | heating mode | freezing mode | defrost mode |
|---|---|---|---|---|
| supercooled expansion valve 76 | open | open | open | open |
| (1-2)$^{th}$ pipe valve 48 | open | closed | open | closed |
| third pipe valve(82) | closed | closed | closed | open (low pressure is used) |
| (1-1)$^{th}$ pipe valve 44 | closed | open | closed | open |
| the first parallel pipe valve 54 | open | closed | open | closed |
| the second parallel pipe valve 58 | | | | |
| the pressure regulating pipe valve 62 | open | open | open | open |
| the check valve 37 | — | — | — | open |
| the second expansion valve 38 | closed | closed | closed | open |
| the first expansion valve 36 | open | open | open | open (heating is used) |
| the flow limiting valve 39 | open | closed | Open | closed |

Hereinafter, referring back to FIGS. 7 to 8, a flow of refrigerant in a freezing mode will be described.

First, a flow of refrigerant in a freezing mode M5 may have the same direction of the flow of the refrigerant in the aforementioned individual cooling mode M4. However, in the freezing mode, an opening degree of the first expansion valve 36, which is disposed in the first liquid pipe 32 and expands the refrigerant flowing into the first heat exchanger 16, may be changed.

That is, in the individual cooling mode, the opening degree of the first expansion valve 36 may be changed to a first opening degree, and in the freezing mode, the opening degree of the first expansion valve 36 may be changed to a second opening degree that is smaller than the first opening degree. Accordingly, in the freezing mode, as the first expansion valve 36 is further closed, an evaporation temperature of the second heat exchanger 18 may be lowered than in a partial cooling mode.

For reference, in the individual cooling mode, the temperature of the evaporator may be maintained above zero. In contrast, in the freezing mode, the temperature of the evaporator may be maintained below zero.

That is, in the freezing mode M5, the same cycle as the individual cooling mode M4 may be configured, an operation may be performed at a target evaporation temperature which is lower than the individual cooling mode M4, and a frequency of the compressor of the outdoor unit 1 may be increased. In this case, the opening degree of the first expansion valve 36 at a side of the first heat exchanger 16, which functions as an evaporator, may be reduced, the temperature of the first heat exchanger 16 may be maintained low by lowering an indoor air volume, and frost may be formed in the first heat exchanger 16.

Referring to (*a*) of FIG. 10, a surface of the first heat exchanger 16, which functions as an evaporation heat exchanger, may be contaminated with condensed water and dust. When the freezing mode proceeds, condensed water and dust on the surface of the first heat exchanger 16 may be frozen together, as shown in (*b*) of FIG. 10. Then, when the freezing mode ends and the defrost mode proceeds to separate the frozen condensed water and dust from the surface of the first heat exchanger 16, the frozen condensed water and foreign matter on the surface of the first heat exchanger 16 may be separated, as shown in (*c*) of FIG. 10.

For reference, as described, in the freezing mode, the second heat exchanger 18 functions as a condensation heat exchanger, and thus, while passing through the first heat exchanger 16, air that is cooled and has lowered humidity may be partially heated while passing through the second heat exchanger 18 and may be introduced into the interior space in a state in which relative humidity is lowered. Thus, as low-temperature air is introduced into the interior space, discomfort felt by a user may be prevented.

Referring to FIG. 9, in a defrost mode, a flow of refrigerant may be confirmed. In a defrost mode M6, the liquid pipe 30 and both of the first pipe 40 and the second pipe 50 may be used. That is, the refrigerant from the outdoor unit 1 may flow into the indoor unit 10 through the liquid pipe 30 and the first pipe 40, and the refrigerant of the indoor unit 10 may flow into the outdoor unit 1 through the second pipe 50.

First, the refrigerant flowing into the indoor unit 10 through the liquid pipe 30 may flow into the second heat exchanger 18 through the third liquid pipe 35. The second heat exchanger 18 may function as an evaporation heat exchanger that phase-changes the liquid refrigerant into low-pressure gaseous refrigerant.

The refrigerant flowing into the indoor unit 10 through the first pipe 40 may flow into the first heat exchanger 16 through the (1-1)$^{th}$ pipe 42. The first heat exchanger 16 may function as a condensation heat exchanger that exchanges heat from high-temperature and high-pressure vapor phase refrigerant to liquid phase. In this case, the (1-1)$^{th}$ pipe valve 44 may open the (1-1)$^{th}$ pipe 42 and the (1-2)$^{th}$ pipe valve 48 may close the (1-2)$^{th}$ pipe 46. The refrigerant discharged from the first heat exchanger 16 may flow along the liquid pipe 30 and may be introduced into the second heat exchanger 18 through the third liquid pipe 35.

Low-pressure gaseous refrigerant discharged from the second heat exchanger 18 may flow in the (1-2)$^{th}$ pipe 46 and may flow into the third pipe 80 branched from the (1-2)$^{th}$ pipe 46. The third pipe 80 may be combined with the second pipe 50. Thus, low-pressure gaseous refrigerant discharged from the second heat exchanger 18 may flow into the second pipe 50 through the (1-2)$^{th}$ pipe 46 and the third pipe 80 and may be introduced into the outdoor unit 1. The third pipe valve 82 that opens the third pipe 80 only in a defrost mode may be installed in the third pipe 80. As a modified example, the refrigerant discharged from the first heat exchanger 16 may flow to the outdoor unit 1 along the liquid pipe 30.

In the above defrost mode, firstly, the opening degree of the first expansion valve 36 connected to the frozen first heat exchanger 16 may be fully opened to perform natural defrosting and drying. Second, as shown in FIG. 9, the first heat exchanger 16 may be converted to a condensation heat exchanger to perform forced defrosting and drying.

The second heat exchanger 18 may be converted to an evaporation heat exchanger. In this case, to convert the second heat exchanger 18 to an evaporation heat exchanger, refrigerant may be introduced into the third liquid pipe 35. In this case, it may also be possible to continuously dehumidify the indoor air via an operation at a preset or predetermined wind volume.

As described above, when the first heat exchanger 16 is converted to the condensation heat exchanger, the second heat exchanger 18 is converted to evaporation heat exchanger, and a defrost mode proceeds, a defrost time may be advantageously reduced. Air supplied to the interior space from the second heat exchanger 18 that functions as an evaporation heat exchanger is continuously dehumidified, and thus, continuous latent heat may be advantageously processed.

Figure 11:
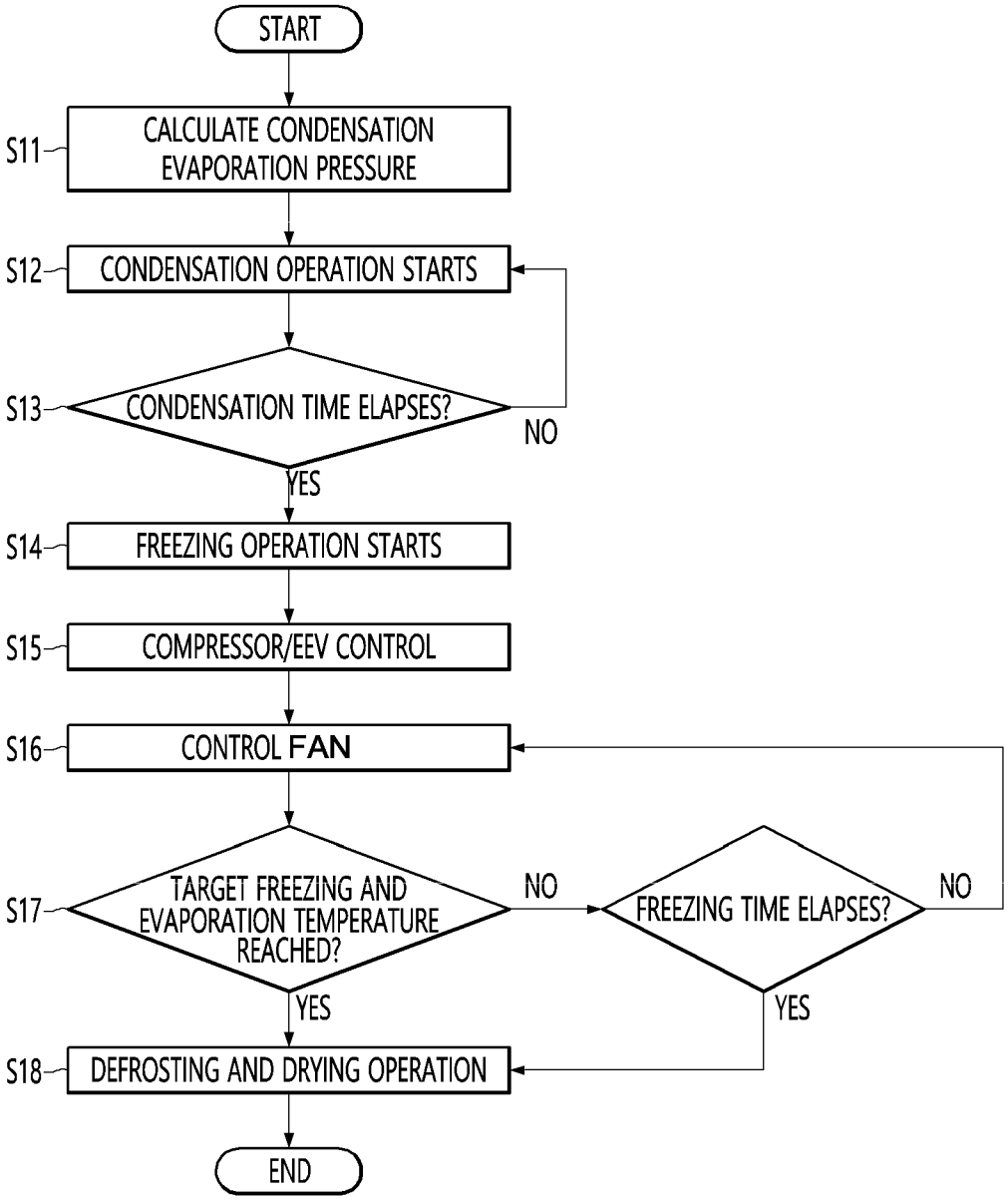
FIG. 11 is a flowchart of freezing and defrosting logic in an air conditioner according to an embodiment.

FIG. 11 is a flowchart of freezing and defrosting logic in an air conditioner according to an embodiment.

In the following description, the term "freeze cleaning" comprehensively means the aforementioned freezing mode and defrost mode.

First, a condensation evaporation pressure may be calculated (S11). In order to increase an amount of condensed water for freeze cleaning, the heat exchanger needs to be operated to form moisture. Therefore, a target evaporation temperature below a dew point temperature may be calculated based on outside temperature and humidity.

Then, a condensation operation may start (S12). That is, compressor frequency (Hz) control may be performed based on a target evaporation pressure. In this case, an outside temperature and an evaporation temperature may be compared. In addition, in order to prepare for a temperature drop of indoor air (SA) during the condensation operation, an opening degree of a condenser-side expansion valve may be controlled.

Next, a condensation time may be checked (S13). When the condensation time has elapsed, a freezing operation may start (S14).

During the freezing operation, a flow of refrigerant may proceed as shown in FIG. 7. That is, after the condensation time has elapsed, the freezing operation may start based on moisture condensed in the heat exchanger and moisture in intake air based on a freezing target evaporation pressure. In this case, the target freezing and evaporation temperature may be set according to the outside temperature and operating conditions of the air conditioner during the condensation operation.

Then, control of the compressor and the expansion valve may start, and control of the blowing fan may also start (S15 and S16). That is, when the blowing fan is not lowered based on a low pressure change, a frequency of the compressor may be increased and the blowing fan may be lowered. That is, control may be performed in response to a compression ratio during operation. In this case, the compression ratio may be controlled to reliably perform freezing, but a maximum frequency may be set.

Then, whether the target freezing and evaporation temperature is reached may be checked (S17). When a predetermined time has elapsed after the target freezing and evaporation temperature is reached, the current operation may enter a defrosting and drying operation (S18). That is, during the defrosting and drying operation, the condensation heat exchanger and the evaporation heat exchanger may be alternately controlled by changing a flow path in the refrigerant distributor. In this case, indoor continuous dehumidification may be possible, and a drying time of the heat exchanger may be shortened.

While embodiments have been particularly shown and described with reference to exemplary embodiments thereof, it is clearly understood that the same is by way of illustration and example only and is not to be taken as limiting. It will be understood by those skilled in the art that various changes in form and details may be made therein without departing from the subject matter and scope.

According to the air conditioner according to embodiments disclosed herein, at least one or more of the following advantages may be provided.

First, the air conditioner may include a plurality of heat exchangers inside of an indoor unit and a refrigerant distributor that controls supply of refrigerant to the plurality of heat exchangers, and thus, may control a temperature and humidity of air supplied to an interior space without consuming separate or additional power. It may be advantageous that power consumption is minimized and pleasant air may be provided to a user.

Second, a flow of refrigerant discharged from a first heat exchanger may be formed through a flow path having two parallel structures. Thus, it may be advantageous that a pressure loss generated in low-pressure refrigerant discharged from a heat exchanger is minimized.

Third, refrigerant flowing through a liquid pipe may sequentially flow through two supercoolers to maximize performance of the first heat exchanger. Fourth, foreign substances, such as dust, adsorbed into the heat exchanger in an outdoor air introduction system may be advantageously removed by freeze cleaning.

Fifth, foreign substances, such as dust, adsorbed into the heat exchanger may be frozen and cleaned and then the heat exchanger may be more quickly dried. Thus, a freeze cleaning time may be advantageously minimized.

Sixth, during freeze cleaning of the heat exchanger, a continuous cooling dehumidification operation may be performed. Thus, indoor humidity may not increase.

Seventh, during freeze cleaning of the heat exchanger, introduced air may be reheated to prevent low-temperature air from flowing in. Thus, there is an advantage that a user does not feel discomfort.

Embodiments disclosed herein provide an air conditioner in which air supplied to an interior space adjusts a temperature and adjusts humidity through a plurality of heat exchangers. Embodiments disclosed herein provide an air conditioner for minimizing power consumption of indoor air through a structure for adjusting refrigerant supplied to the plurality of heat exchangers.

Embodiments disclosed herein provide an air conditioner for minimizing a pressure loss due to flow of refrigerant. Embodiments disclosed herein further provide an air conditioner for maximizing performance of an evaporator.

Embodiments disclosed herein provide an air conditioner for removing foreign substances, such as dust, adsorbed into a heat exchanger from an outdoor air introduction system via freeze cleaning. Embodiments disclosed herein also provide an air conditioner for minimizing a freeze cleaning time by more quickly drying a heat exchanger after freeze cleaning foreign substances, such as dust, adsorbed into a heat exchanger.

Embodiments disclosed herein provide an air conditioner for overcoming a problem of increasing humidity of an interior space due to moisture in introduced air during freezing cleaning of a heat exchanger. Embodiments disclosed herein additionally provide an air conditioner for overcoming user discomfort while low-temperature air is introduced by reheating the introduced air during freeze cleaning of a heat exchanger.

Embodiments disclosed herein provide an air conditioner that may include at least one indoor unit including a case having a supply flow path that is formed therein and through which outside air flows into an interior space, a first heat exchanger that is disposed on the supply flow path, in which refrigerant flows, and that exchanges heat between the flowing air and the refrigerant, a second heat exchanger that is disposed downstream of the second heat exchanger on the supply flow path, in which refrigerant selectively flows, and that exchanges heat between the flowing air and the refrigerant, and a refrigerant distributer configured to send refrigerant to the first heat exchanger or the second heat exchanger.

The refrigerant distributer may include a liquid pipe that is connected to each of the first heat exchanger and the second heat exchanger and through which a liquid refrigerant flows, a first pipe that is connected to each of the first heat exchanger and the second heat exchanger and in which vapor phase refrigerant flows, a second pipe in which gas refrigerant discharged from the first heat exchanger and the second heat exchanger flows, a first pipe valve that is disposed on the first pipe and configured to send the refrigerant flowing in the first pipe to the first heat exchanger or the second heat exchanger, and a second pipe valve disposed on the second pipe and configured to open and close the second pipe. When the first heat exchanger operates as an evaporator, the second heat exchanger may operate as a condenser. When the first heat exchanger operates as a condenser, the first heat exchanger may operate as an evaporator. When the first heat exchanger operates as a condenser or an evaporator while refrigerant flows into the first heat exchanger, flow of refrigerant may be blocked in the second heat exchanger.

The liquid pipe may be branched into a first liquid pipe connected to the first heat exchanger and a second liquid pipe connected to the second heat exchanger. The air conditioner may further include a third liquid pipe that is branched from the liquid pipe and then combined with the second liquid pipe.

A check valve and a second expansion valve may be installed in the third liquid pipe. A flow limiting valve configured to limit flow of refrigerant may be installed in the second liquid pipe.

The first pipe may be branched into a $(\mathbf{1\text{-}1})^{th}$ pipe connected to the first heat exchanger and a $(\mathbf{1\text{-}2})^{th}$ pipe connected to the second heat exchanger. The first pipe valve may include a $(\mathbf{1\text{-}1})^{th}$ valve disposed in the $(\mathbf{1\text{-}1})^{th}$ pipe and configured to open and close the $(\mathbf{1\text{-}1})^{th}$ pipe and a $(\mathbf{1\text{-}2})^{th}$ valve disposed in the $(\mathbf{1\text{-}2})^{th}$ pipe and configured to open and close the $(\mathbf{1\text{-}2})^{th}$ pipe. When refrigerant flows into the second pipe, the $(\mathbf{1\text{-}1})^{th}$ valve may close the $(\mathbf{1\text{-}1})^{th}$ pipe.

The second pipe may include a first parallel pipe and a second parallel pipe that are branched and combined in the refrigerant distributer. The second pipe valve may include a first parallel pipe valve configured to open and close the first parallel pipe and a second parallel pipe valve configured to open and close the second parallel pipe. The second pipe may further include a pressure regulating pipe that is branched upstream of the first parallel pipe and the second parallel pipe and is combined downstream of the first parallel pipe and the second parallel pipe.

A pressure regulating pipe valve configured to open and close an internal flow path of the pressure regulating pipe may be disposed on the pressure regulating pipe. When a flow of refrigerant is stopped, the first parallel pipe valve and the second parallel pipe valve may close the first parallel pipe and the second parallel pipe, respectively, and the pressure regulating pipe valve may open the pressure regulating pipe.

The first heat exchanger may have a larger passage area than the second heat exchanger.

The air conditioner may further include a connection pipe that connects the first pipe and the second pipe and a connection pipe valve configured to open and close the connection pipe.

The liquid pipe may include a supercooler configured to supercool refrigerant flowing in the liquid pipe by expanding and exchanging heat with a portion of the refrigerant flowing in the liquid pipe.

The supercooler may include a first supercooler and a second supercooler disposed upstream of the first supercooler on the liquid pipe. Refrigerant branched from the liquid pipe may sequentially flow in the first supercooler and the second supercooler.

The air conditioner may further include a branch pipe branched from the liquid pipe and connected to the supercooler. After passing through the supercooler through a supercooled expansion valve, refrigerant flowing in the branch pipe may flow in the second pipe. When the first heat exchanger heats air flowing in the supply flow path, the refrigerant distributer may stop supplying refrigerant to the second heat exchanger.

The air conditioner may further include a third pipe that is branched from the first pipe and then combined with the second pipe to guide refrigerant discharged from the second heat exchanger to the second pipe, and a third pipe valve configured to regulate flow of refrigerant may be installed in the third pipe.

The air conditioner may further include an outdoor unit including a compressor configured to compress refrigerant and an outdoor heat exchanger configured to exchange heat between refrigerant and outside air. The indoor unit may be provided in a plural number, may be connected to the outdoor unit through a plurality of refrigerant pipes, and may adjust a temperature of air flowing into an interior space.

Details of other embodiments are included in the detailed description and drawings.

The effects of embodiments are not limited to the effects mentioned above, and other effects not mentioned will be clearly understood by those skilled in the art from the description of the claims.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner, comprising:

a case having a supply flow path formed therein and through which air flows into an interior space;

a first heat exchanger disposed on the supply flow path, in which refrigerant flows, and that exchanges heat between the air and the refrigerant;

a second heat exchanger disposed downstream of the first heat exchanger on the supply flow path, in which the refrigerant selectively flows, and that exchanges heat between the air and the refrigerant; and a refrigerant distributer configured to send the refrigerant to the first heat exchanger or the second heat exchanger, wherein the refrigerant distributer is provided in at least one indoor unit and includes:

a liquid pipe connected to each of the first heat exchanger and the second heat exchanger and through which liquid refrigerant flows;

a first pipe connected to each of the first heat exchanger and the second heat exchanger and in which vapor phase refrigerant flows;

a second pipe in which gas refrigerant discharged from the first heat exchanger and the second heat exchanger flows;

a first pipe valve disposed on the first pipe and configured to send the refrigerant flowing in the first pipe to the first heat exchanger or the second heat exchanger; and a second pipe valve disposed on the second pipe and configured to open and close the second pipe, wherein the first pipe is branched into a $(\mathbf{1\text{-}1})^{th}$ pipe connected to the first heat exchanger and a $(\mathbf{1\text{-}2})^{th}$ pipe connected to the second heat exchanger, wherein the first pipe valve includes a $(\mathbf{1\text{-}1})^{th}$ valve disposed in the $(\mathbf{1\text{-}1})^{th}$ pipe and configured to open and close the $(\mathbf{1\text{-}1})^{th}$ pipe, and a $(\mathbf{1\text{-}2})^{th}$ valve disposed in the $(\mathbf{1\text{-}2})^{th}$ pipe and configured to open and close the $(\mathbf{1\text{-}2})^{th}$ pipe, wherein when the $(\mathbf{1\text{-}1})^{th}$ valve opens the $(\mathbf{1\text{-}1})^{th}$ pipe, the $(\mathbf{1\text{-}2})^{th}$ valve closes the $(\mathbf{1\text{-}2})^{th}$ pipe, wherein when the $(\mathbf{1\text{-}2})^{th}$ valve opens the $(\mathbf{1\text{-}2})^{th}$ pipe, the $(\mathbf{1\text{-}1})^{th}$ valve closes the $(\mathbf{1\text{-}1})^{th}$ pipe, wherein when the $(\mathbf{1\text{-}1})^{th}$ valve is opened, the refrigerant that passed through the first heat exchanger passes through the second heat exchanger, wherein when the $(\mathbf{1\text{-}2})^{th}$ valve is opened, the refrigerant that passed through the second heat exchanger passes through the first heat exchanger, wherein the second pipe includes a first parallel pipe and a second parallel pipe branched and combined in the refrigerant distributer wherein the second pipe valve includes a first parallel pipe valve configured to open and close the first parallel pipe, and a second parallel pipe valve configured to open and close the second parallel pipe, wherein when the $(\mathbf{1\text{-}1})^{th}$ valve opens the $(\mathbf{1\text{-}1})^{th}$ pipe and the $(\mathbf{1\text{-}2})^{th}$ valve closes the $(\mathbf{1\text{-}2})^{th}$ pipe, the first parallel pipe valve and the second parallel pipe valve close, respectively, the first parallel pipe and the second parallel pipe, and wherein when the $(\mathbf{1\text{-}2})^{th}$ valve opens the $(\mathbf{1\text{-}2})^{th}$ pipe and the $(\mathbf{1\text{-}1})^{th}$ valve closes the $(\mathbf{1\text{-}1})^{th}$ pipe, the first parallel pipe valve and the second parallel pipe valve open, respectively, the first parallel pipe and the second parallel pipe.

2. The air conditioner of claim 1, wherein when the first heat exchanger operates as an evaporator, the second heat exchanger operates as a condenser.

3. The air conditioner of claim 1, wherein when the first heat exchanger operates as a condenser, the second heat exchanger operates as an evaporator.

4. The air conditioner of claim 1, wherein when the first heat exchanger operates as a condenser or an evaporator while the refrigerant flows into the first heat exchanger, a flow of the refrigerant is blocked in the second heat exchanger.

5. The air conditioner of claim 1, wherein the liquid pipe is branched into a first liquid pipe connected to the first heat exchanger and a second liquid pipe connected to the second heat exchanger.

6. The air conditioner of claim 1, wherein when the refrigerant flows into the second pipe, the $(1\text{-}1)^{th}$ valve closes the $(1\text{-}1)^{th}$ pipe or the $(1\text{-}2)^{th}$ valve closes the $(1\text{-}2)^{th}$ pipe.

7. The air conditioner of claim 1, wherein the second pipe further includes a pressure regulating pipe branched upstream of the first parallel pipe and the second parallel pipe and combined downstream of the first parallel pipe and the second parallel pipe.

8. The air conditioner of claim 1, wherein the first heat exchanger has a larger passage area than the second heat exchanger.

9. The air conditioner of claim 1, further comprising:

a connection pipe that connects the first pipe and the second pipe and a connection pipe valve configured to open and close the connection pipe.

10. The air conditioner of claim 1, wherein the liquid pipe includes a supercooler configured to supercool refrigerant flowing in the liquid pipe by expanding and exchanging heat with a portion of the refrigerant flowing in the liquid pipe.

11. The air conditioner of claim 1, wherein when the first heat exchanger heats air flowing in the supply flow path, the refrigerant distributer stops supplying the refrigerant to the second heat exchanger.

12. The air conditioner of claim 1, further comprising:

a third pipe branched from the first pipe and then combined with the second pipe to guide the refrigerant discharged from the second heat exchanger to the second pipe, wherein a third pipe valve configured to regulate a flow of the refrigerant is installed in the third pipe.

13. The air conditioner of claim 1, further comprising:

an outdoor unit including a compressor configured to compress the refrigerant, and an outdoor heat exchanger configured to exchange heat between the refrigerant and the air, wherein the at least one indoor unit comprises a plurality of indoor units that are fluidly connected to the outdoor unit to exchange the refrigerant, and that adjust a temperature of the air flowing into the interior space.

14. The air conditioner of claim 5, further comprising:

a third liquid pipe branched from the liquid pipe and then combined with the second liquid pipe.

15. The air conditioner of claim 14, wherein a check valve and a second expansion valve are installed in the third liquid pipe.

16. The air conditioner of claim 14, wherein a flow limiting valve configured to limit a flow of the refrigerant is installed in the second liquid pipe.

17. The air conditioner of claim 7, wherein a pressure regulating pipe valve configured to open and close an internal flow path of the pressure regulating pipe is disposed on the pressure regulating pipe, and wherein when a flow of the refrigerant is stopped, the first parallel pipe valve and the second parallel pipe valve close the first parallel pipe and the second parallel pipe, respectively, and the pressure regulating pipe valve opens the pressure regulating pipe.

18. The air conditioner of claim 10, wherein the supercooler includes a first supercooler and a second supercooler disposed upstream of the first supercooler on the liquid pipe, and wherein the refrigerant branched from the liquid pipe sequentially flows in the first supercooler and the second supercooler.

19. The air conditioner of claim 18, further comprising:

a branch pipe branched from the liquid pipe and connected to the supercooler, wherein after passing through the supercooler and a supercooled expansion valve, the refrigerant flowing in the branch pipe flows into the second pipe.

20. An air conditioner, comprising:

a case having a supply flow path formed therein and through which air flows into an interior space;

a first heat exchanger disposed on the supply flow path, in which refrigerant flows, and that exchanges heat between the air and the refrigerant;

a second heat exchanger disposed downstream of the first heat exchanger on the supply flow path, in which the refrigerant selectively flows, and that exchanges heat between the air and the refrigerant; and a refrigerant distributer configured to send the refrigerant to the first heat exchanger or the second heat exchanger, wherein the refrigerant distributer includes:

a liquid pipe connected to each of the first heat exchanger and the second heat exchanger and through which liquid refrigerant flows, wherein the liquid pipe is branched into a first liquid pipe connected to the first heat exchanger and a second liquid pipe connected to the second heat exchanger;

a first pipe connected to each of the first heat exchanger and the second heat exchanger and in which vapor phase refrigerant flows;

a second pipe in which gas refrigerant discharged from the first heat exchanger and the second heat exchanger flows;

a first pipe valve disposed on the first pipe and configured to send the refrigerant flowing in the first pipe to the first heat exchanger or the second heat exchanger; and a second pipe valve disposed on the second pipe and configured to open and close the second pipe, wherein the first pipe is branched into a $(1\text{-}1)^{th}$ pipe connected to the first heat exchanger and a $(1\text{-}2)^{th}$ pipe connected to the second heat exchanger;

wherein the first pipe valve includes a $(1\text{-}1)^{th}$ valve disposed in the $(1\text{-}1)^{th}$ pipe and configured to open and close the $(1\text{-}1)^{th}$ pipe and a $(1\text{-}2)^{th}$ valve disposed in the $(1\text{-}2)^{th}$ pipe and configured to open and close the $(1\text{-}2)^{th}$ pipe, wherein when the $(1\text{-}1)^{th}$ valve opens $(1\text{-}1)^{th}$ pipe, the $(1\text{-}2)^{th}$ valve closes the $(1\text{-}2)^{th}$ pipe, wherein when the $(1\text{-}2)^{th}$ valve opens $(1\text{-}2)^{th}$ pipe, the $(1\text{-}1)^{th}$ valve closes the $(1\text{-}1)^{th}$ pipe, and wherein when the $(1\text{-}1)^{th}$ valve is opened, the refrigerant that passed through the first heat exchanger passes through the second heat exchanger, wherein when the $(1\text{-}2)^{th}$ valve is opened, the refrigerant that passed through the second heat exchanger passes through the first heat exchanger, wherein the second pipe includes a first parallel pipe and a second parallel pipe branched and combined in the refrigerant distributer wherein the second pipe valve includes a first parallel pipe valve configured to open and close the first parallel pipe, and a second parallel pipe valve configured to open and close the second parallel pipe, wherein when the $(\mathbf{1\text{-}1})^{th}$ valve opens the $(\mathbf{1\text{-}1})^{th}$ pipe and the $(\mathbf{1\text{-}2})^{th}$ valve closes the $(\mathbf{1\text{-}2})^{th}$ pipe, the first parallel pipe valve and the second parallel pipe valve close, respectively, the first parallel pipe and the second parallel pipe, and wherein when the $(\mathbf{1\text{-}2})^{th}$ valve opens the $(\mathbf{1\text{-}2})^{th}$ pipe and the $(\mathbf{1\text{-}1})^{th}$ valve closes the $(\mathbf{1\text{-}1})^{th}$ pipe, the first parallel pipe valve and the second parallel pipe valve open, respectively, the first parallel pipe and the second parallel pipe.

* * * * *